US008245650B1

(12) United States Patent
McKsymick

(10) Patent No.: US 8,245,650 B1
(45) Date of Patent: Aug. 21, 2012

(54) PORTABLE, COMPACT COMPUTER STAND

(76) Inventor: Mark McKsymick, Fountain Hills, AZ (US)

( * ) Notice: Subject to any disclaimer, the term of this patent is extended or adjusted under 35 U.S.C. 154(b) by 25 days.

(21) Appl. No.: 13/031,711

(22) Filed: Feb. 22, 2011

(51) Int. Cl.
*A47B 85/00* (2006.01)

(52) U.S. Cl. ..... 108/25; 108/26

(58) Field of Classification Search ..... 108/25, 108/26, 33, 34, 38, 11, 14, 13, 150; 206/216, 206/218, 557, 564, 562, 523
See application file for complete search history.

(56) References Cited

U.S. PATENT DOCUMENTS

| | | | | |
|---|---|---|---|---|
| 1,098,482 | A * | 6/1914 | Combes | 108/26 |
| 1,807,589 | A * | 6/1931 | Edmunds | 108/26 |
| 2,568,534 | A * | 9/1951 | Baker | 108/33 |
| 2,926,794 | A * | 3/1960 | Karoff | 108/26 |
| 4,887,536 | A * | 12/1989 | Teichner | 108/35 |
| 5,556,181 | A * | 9/1996 | Bertrand | 108/25 |
| 5,720,226 | A * | 2/1998 | Padovano | 108/25 |
| 5,860,367 | A * | 1/1999 | Riegel et al. | 108/26 |
| 6,032,590 | A * | 3/2000 | Chen | 108/38 |
| 6,311,944 | B1 | 11/2001 | McKsymick et al. | |
| 6,637,350 | B2 * | 10/2003 | McKsymick | 108/25 |
| 6,662,732 | B2 * | 12/2003 | Birsel et al. | 108/25 |
| 6,964,595 | B2 * | 11/2005 | Libretti | 108/25 |
| 6,976,434 | B2 * | 12/2005 | Roig et al. | 108/25 |
| 7,104,398 | B1 * | 9/2006 | Wisecarver | 206/523 |
| 7,207,450 | B1 * | 4/2007 | Franklin et al. | 108/25 |
| 7,549,381 | B1 * | 6/2009 | Nail et al. | 108/26 |
| 8,100,061 | B2 * | 1/2012 | Hookway et al. | 108/26 |
| 8,104,615 | B2 * | 1/2012 | Liu | 206/523 |
| 2002/0040667 | A1 * | 4/2002 | Birsel et al. | 108/25 |

* cited by examiner

*Primary Examiner* — Jose V Chen
(74) *Attorney, Agent, or Firm* — John D. Gugliotta, PE, Esq.

(57) ABSTRACT

A portable, compact computer and projector stand is provided that is adapted to be utilized in conjunction with a cellular phone storage adapter and a cup holding adapter. The cell phone storage adapter is formed of a separable housing forming a containment cavity therein. An attachment pin is mounted cantilevered from the outer periphery of the housing to provide for attachment through impingement with a first receiving hole in the table top. A closed cell foam insert fitted within the containment cavity is adapted to graspingly receive, and consequently securely hold, a cellular telephone, portable digital assistant (PDA) or similar handheld electronic device. The cup holding adapter for use in conjunction with the stand incorporates a coaster support platform having an attachment pin mounted cantilevered from the outer periphery of the platform to provide for attachment through impingement with a second receiving hole in the table top. An upper containment ring can further be adapted to attachably affix to and above the coaster support platform, thereby forming a secure beverage container holder.

8 Claims, 9 Drawing Sheets

PORTABLE, COMPACT COMPUTER STAND

RELATED APPLICATIONS

None.

BACKGROUND OF THE INVENTION

1. Field of the Invention

The present invention relates generally to a portable table for holding and supporting laptop computers, projectors, and associated components and, more particularly, to an improved portable, compact computer stand that is adapted to incorporate article holders for organizing additional accessories, such as cell phones, beverage containers and the like.

2. Description of the Related Art

In recent years, portable laptop and projector stands have been commercially available and have become a "must have" for the business traveler. Sold under the trade name TABLETOTE™, such devices have been widely accepted and successful as a convenient and useful tool for professionals, students, speakers or anyone "on the go" needing a mobile, compact, lightweight, sturdy and adjustable work surface. Through thousands of hours of use and tens of thousands of TABLETOTE™ products sold, the commercial embodiment of the devices (described and protected by U.S. Pat. Nos. 6,311,944 and 6,637,350 herein incorporated by reference as if fully rewritten), have been found to be function effectively and efficiently for fast and easy setups. In such devices, the bottom cover of the work surface slides off, exposing the collapsed legs which are neatly stored in its underbelly. The bottom cover then slides onto the top of the table to create a work surface expandable to up to 22 inches long by a 10.5 inch fixed width, enough to accommodate a laptop and a mouse pad, or to support a portable projector, or simply to extend a work surface. Telescoping legs securely lock to the workstation platform, and telescope to from between 13 to 30 inches.

However, while successful in functioning as a versatile workstation that is lightweight and compact enough to easily fit into briefcases, laptop cases, or backpacks, through the successful use a number of improvements and features not obvious are now known that, if provided, would greatly increase the functionality and flexibility of such portable workstation platforms.

Consequently, a need has been felt for providing a portable, compact computer and projector stand having an adjustable height for supporting laptop computers, projectors, and associated components of the prior designs, but with improved adjustability and functionality.

SUMMARY OF THE INVENTION

Briefly described according to one embodiment of the present invention, a portable, compact computer and projector stand is provided for supporting laptop computers projectors and associated components and having a generally planar table top designed to slidably a generally planar table bottom. A plurality of linearly elongated channels integrally formed along the table bottom serve as a track guide for slidably receiving an L-shaped track receiving lip of the table top. The channels have a plurality of spring-loaded detents aligned at spaced locations along a linear length therein for allowing selective linear adjustment of the table top. A medium density, closed cell foam insert is provided and is dimensionally-shaped so as to correspondingly rest in a fitting and snug manner within the accessory insert receiving cavity formed within the lower surface of the table bottom. The foam insert serves as a storage volume for telescoping legs and other accessories. The telescoping legs are each comprised of three leg members of decreasing diameters and are removably secured within a pocket of the table bottom via a plastic collet. Additional specific improvements to the improved portable, compact computer stands are provided in the form of article holders for organizing additional accessories, such as cell phones, beverage containers and the like. A cellular phone storage adapter for use in conjunction with the stand includes separable housing forming a containment cavity therein. An attachment pin is mounted cantilevered from the outer periphery of the housing to provide for attachment through impingement with a first receiving hole in the table top. A closed cell foam insert fitted within the containment cavity is adapted to graspingly receive, and consequently securely hold, a cellular telephone, portable digital assistant (PDA) or similar hand-held electronic device.

Further, a cup holding adapter for use in conjunction with the stand incorporates a coaster support platform having an attachment pin mounted cantilevered from the outer periphery of the platform to provide for attachment through impingement with a second receiving hole in the table top. An upper containment ring can further be adapted to attachably affix to and above the coaster support platform, thereby forming a secure beverage container holder.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
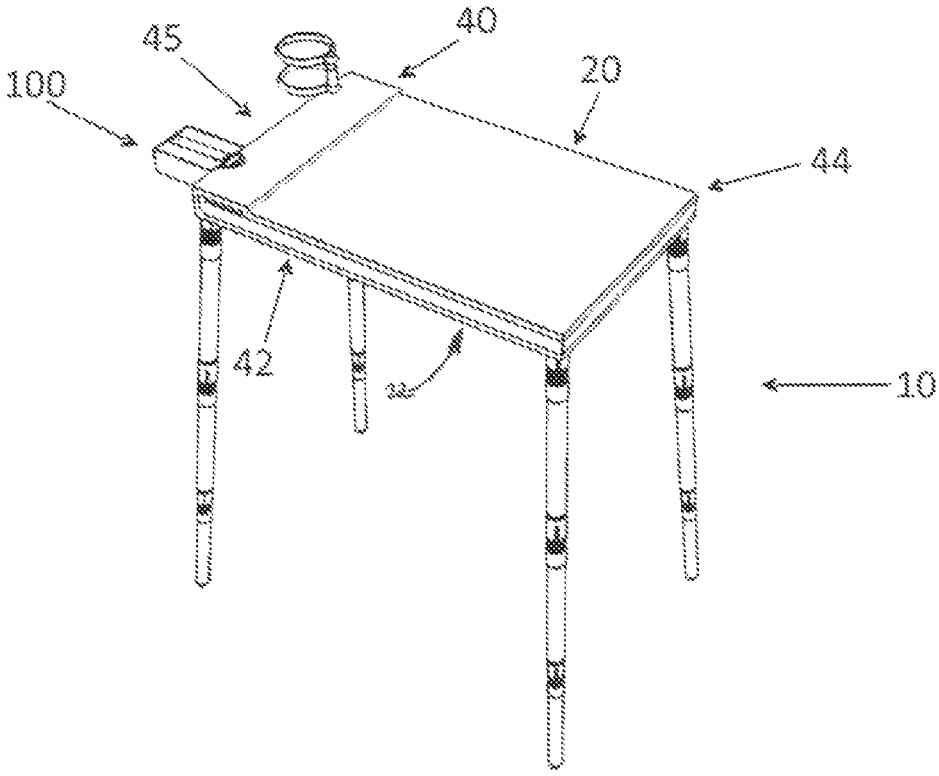
FIG. 1 is a front perspective view of an improved portable, compact computer and projector stand according to the preferred embodiment of the present invention.
Figure 2:
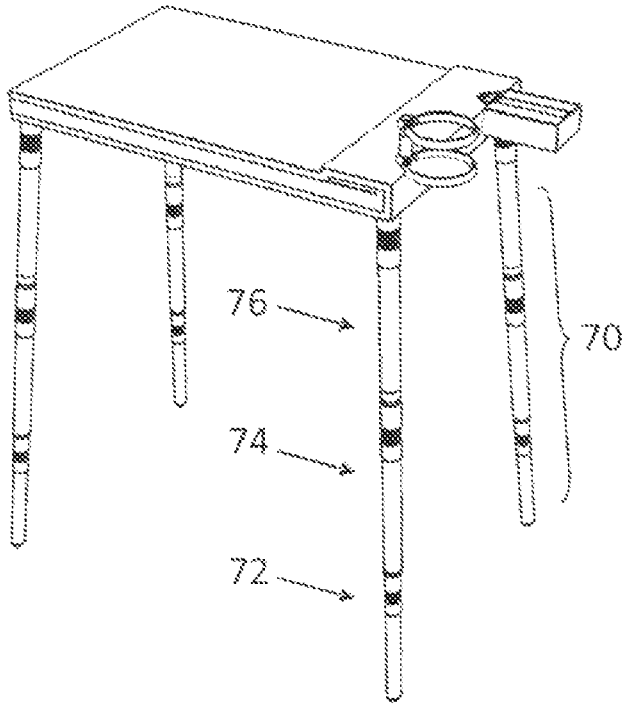
FIG. 2 is a rear perspective view thereof.
Figure 3:
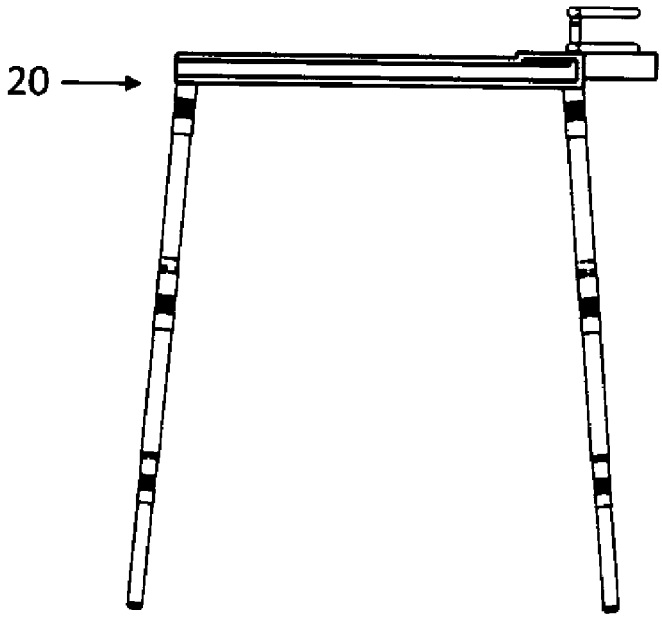
FIG. 3 is a front elevational view thereof.
Figure 4:
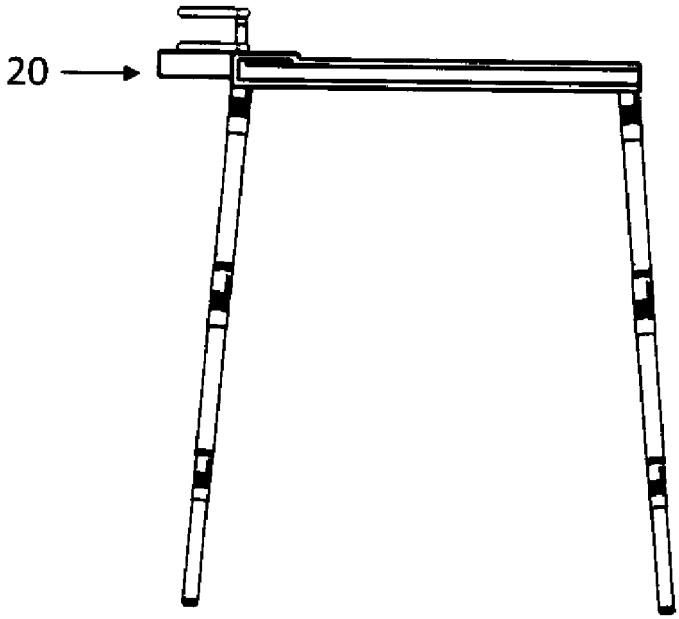
FIG. 4 is a rear elevational view thereof.
Figure 5:
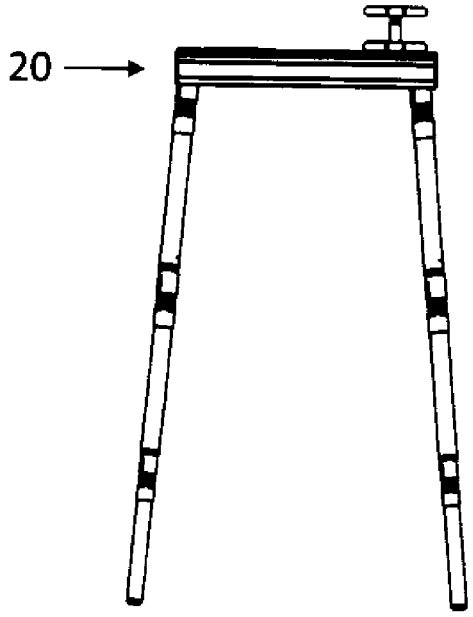
FIG. 5 is a left side elevational view thereof.
Figure 6:
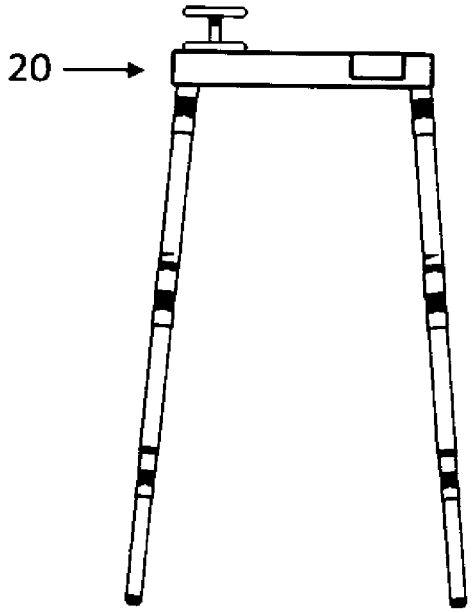
FIG. 6 is a right side elevational view thereof.
Figure 7:
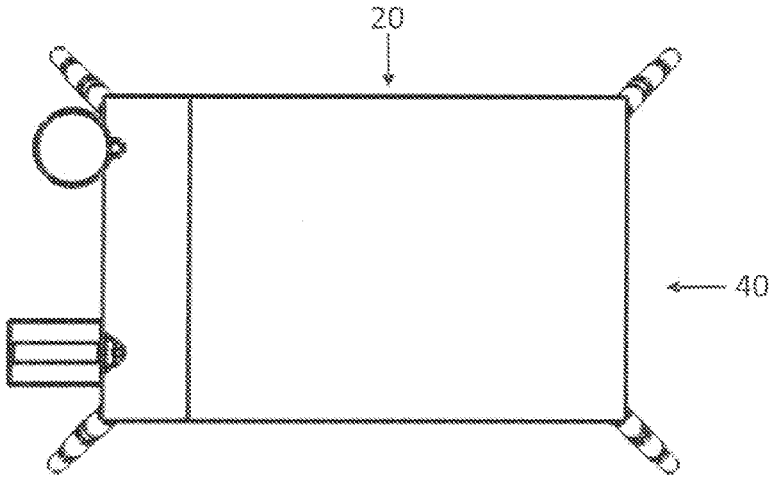
FIG. 7 is a top plan view thereof.
Figure 8:
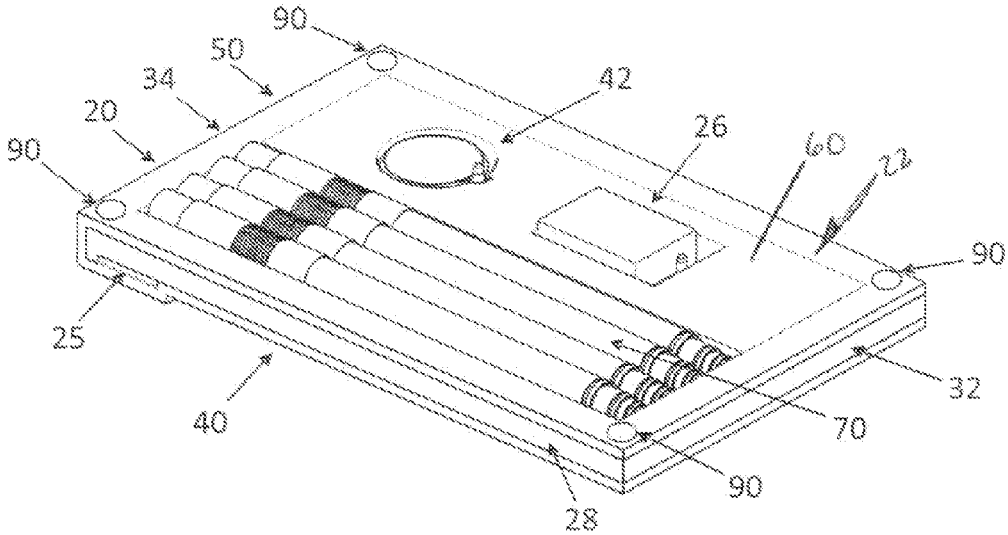
FIG. 8 is a bottom perspective view thereof, shown in a collapsed, storage position having the legs and accessories stored beneath the table top 20.
Figure 9:
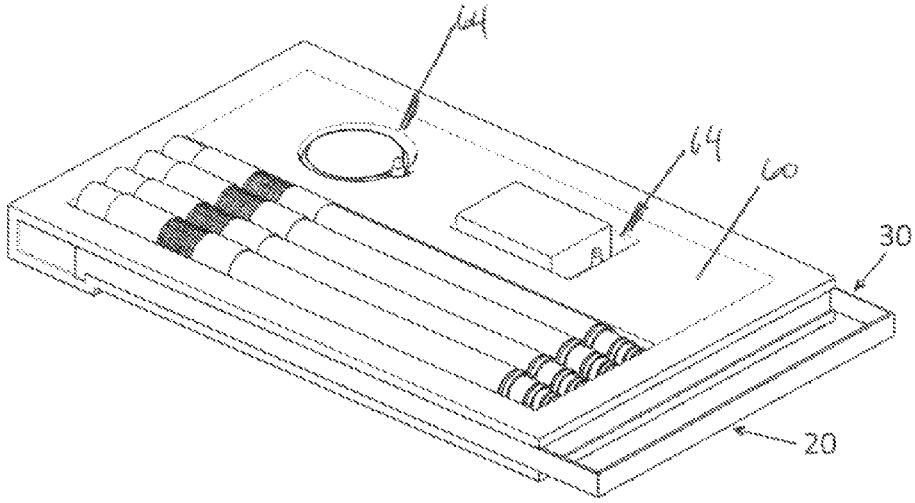
FIG. 9 is a bottom perspective view thereof, shown similar to FIG. 8 but including a table bottom 22.

Referring now to FIGS. 1-9, an improved portable, compact computer and projector stand 10 is shown, according to the present invention, comprising a generally planar table top 20 designed to slidably engage a generally planar table bottom 22. The table top 20 is constructed of a rigid plastic material and is defined as having a table bottom receiving end 32 opposite an enclosed end 34. The table top 20 is further defined as having a L-shaped track receiving lip 30 circumscribing a substantial portion of an upper surface 24 thereof and extending perpendicularly downward. The table bottom 22 is constructed of a rigid plastic material and is defined as having an upper surface 40 opposite a lower surface 42. The upper surface 40 is of a split-level design comprising a primary top 44 and a secondary top 45. Integrally formed and extending perpendicularly downward along opposite sides 25, 26 of the table bottom 22 are a plurality of linearly elongated channels 28 comprising which serves as a guide for slidably receiving the L-shaped track receiving lip 30 of the table top 20. Upon linear engagement of the L-shaped track receiving lip 30 with the channels 28, the table bottom receiving end 32 meets the top 44 of the table bottom 22 in a substantially flush manner, thereby forming a flat planar upper surface as shown.

The lower surface 42 of the table bottom 22 is comprised of a floor circumscribed by walls which form a generally rectangular, accessory insert receiving cavity 50. A plurality of specifically shaped cavities 55 are molded in a recessed manner to provide additional storage space, as described in greater detail below.

Figure 10:
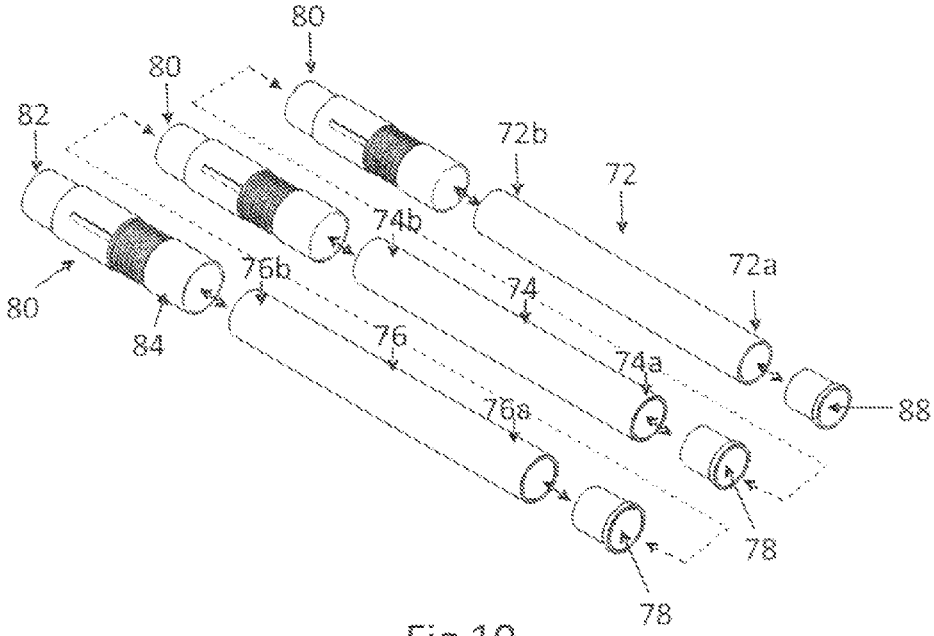
FIG. 10 is an exploded perspective view of the telescoping legs according to the preferred embodiment of the present invention.
Figure 11:
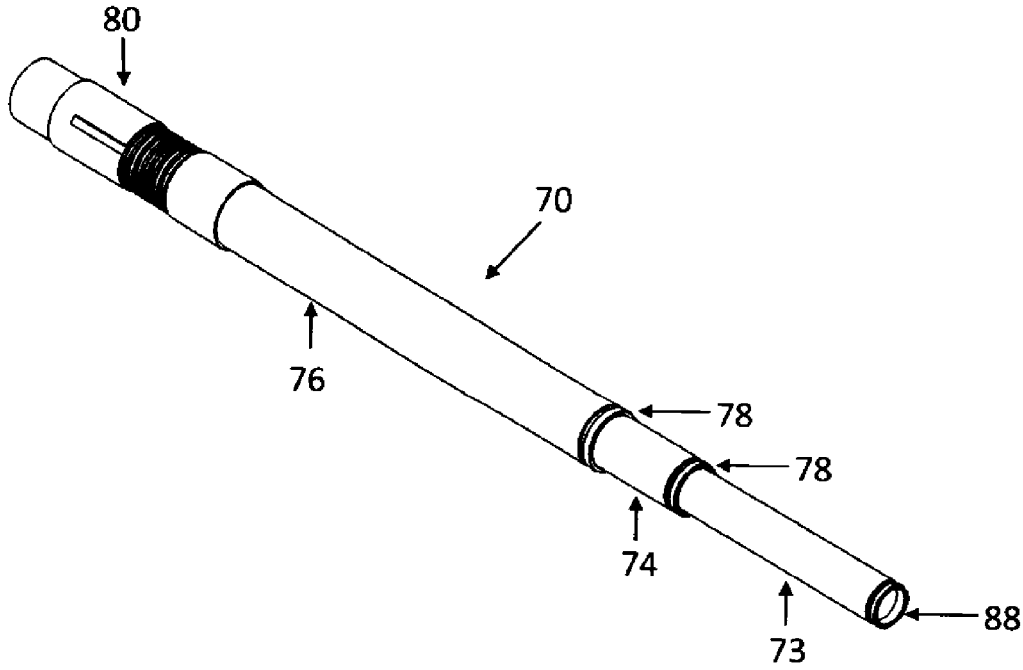
FIG. 11 is a perspective view of an assembled telescoping leg according to the preferred embodiment of the present invention.
Figure 12:
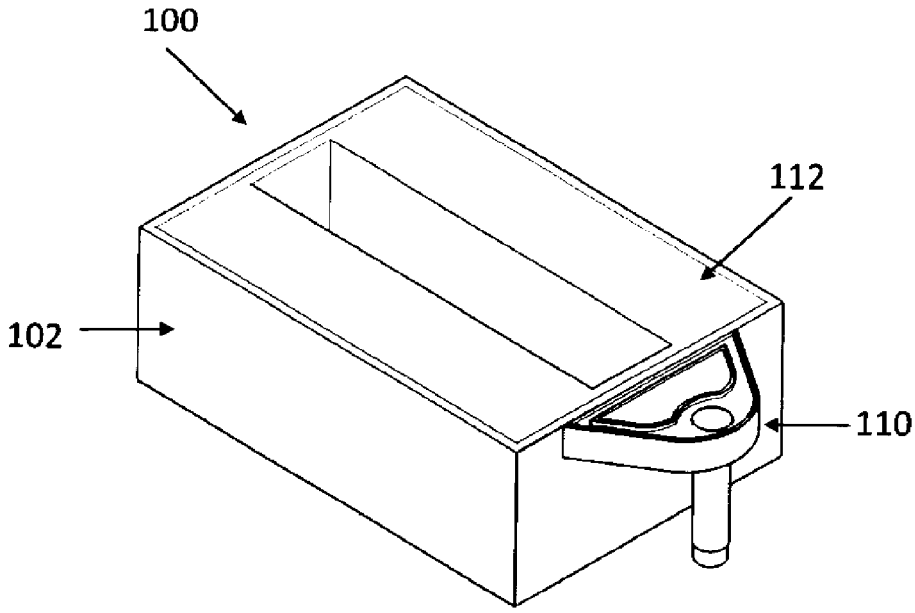
FIG. 12 is a perspective view of a cellular phone storage adapter for use in conjunction with the improved portable, compact computer and projector stand according to the preferred embodiment of the present invention.
Figure 13:
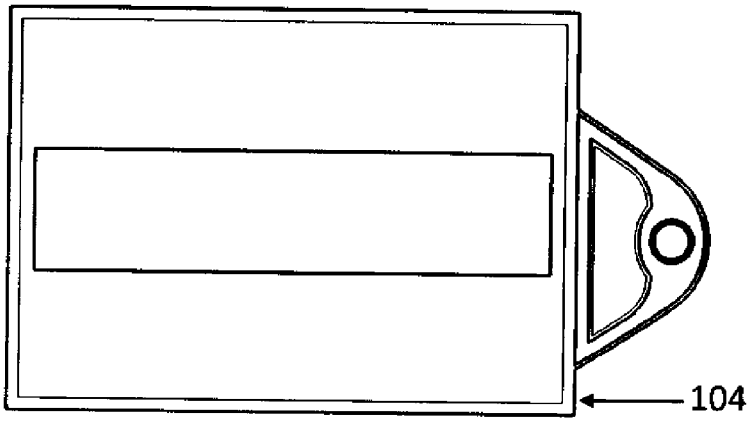
FIG. 13 is a top plan view of the storage adapter of FIG. 12.
Figure 14:
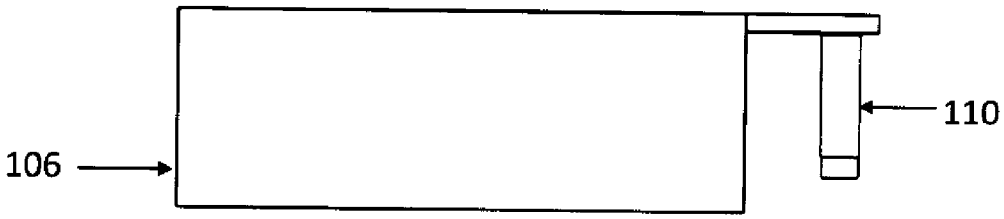
FIG. 14 is a left side elevational view of the storage adapter of FIG. 12, the right side being a mirror image thereof.
Figure 15:
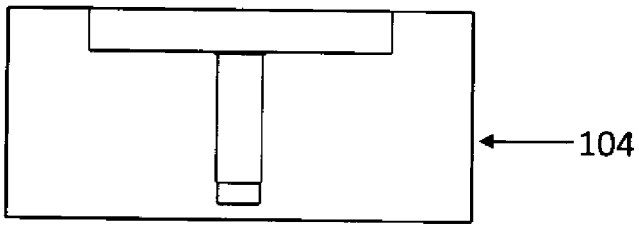
FIG. 15 is a front elevational view of the storage adapter of FIG. 12.
Figure 16:
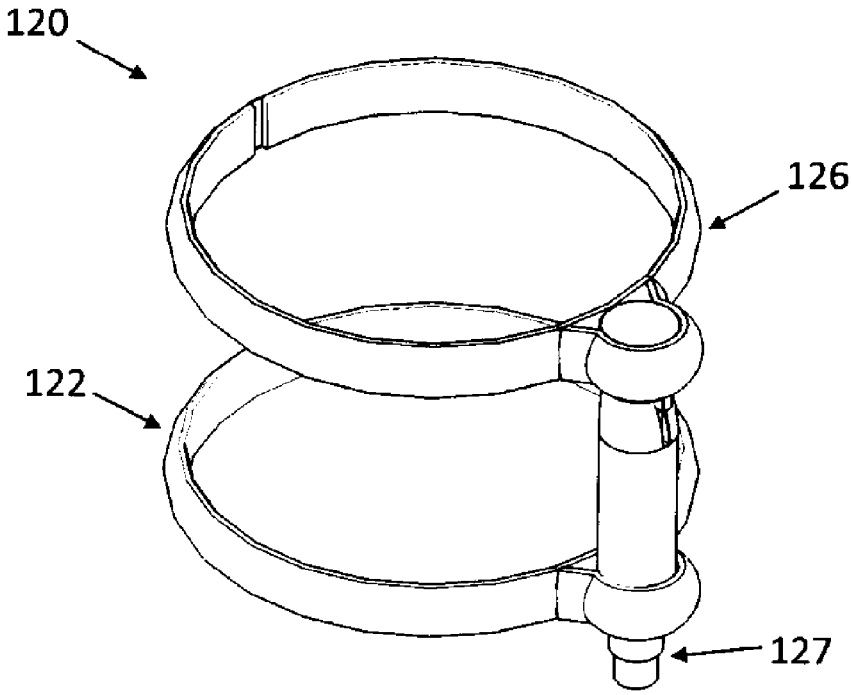
FIG. 16 is a perspective view of a cup holding adapter for use in conjunction with the improved portable, compact computer and projector stand according to the preferred embodiment of the present invention.
Figure 17:
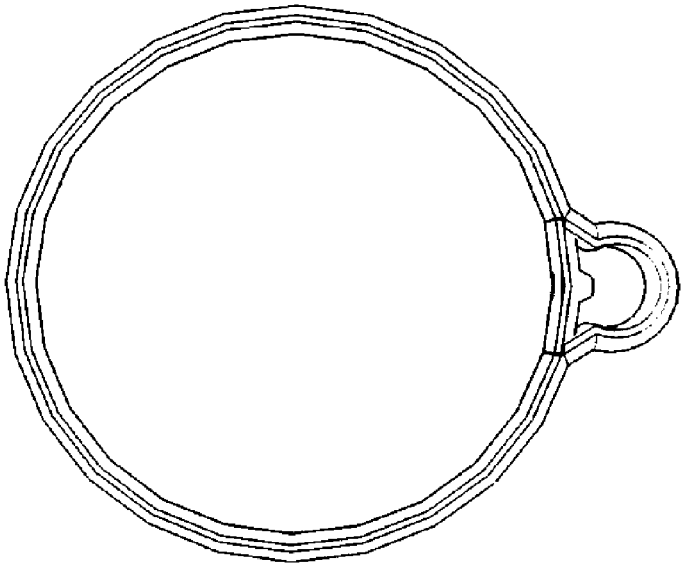
FIG. 17 is a top plan view of the cup holding adapter of FIG. 16.
Figure 18:
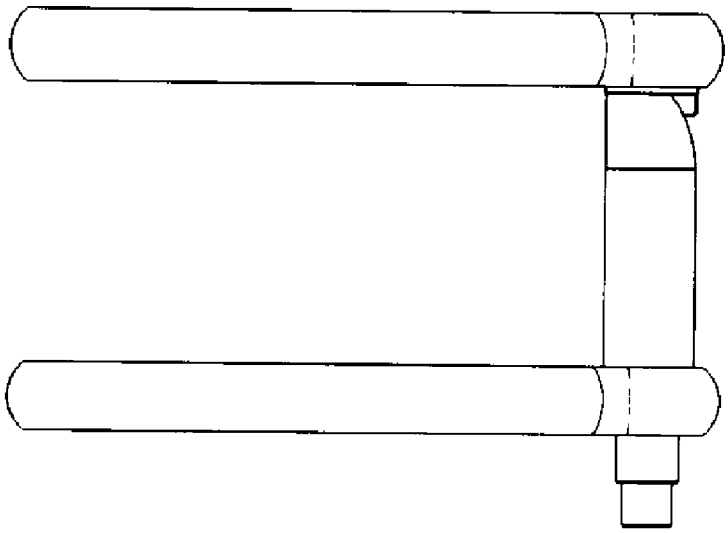
FIG. 18 is a left side elevational view of the cup holding adapter of FIG. 16, the right side being a mirror image thereof.
Figure 19:
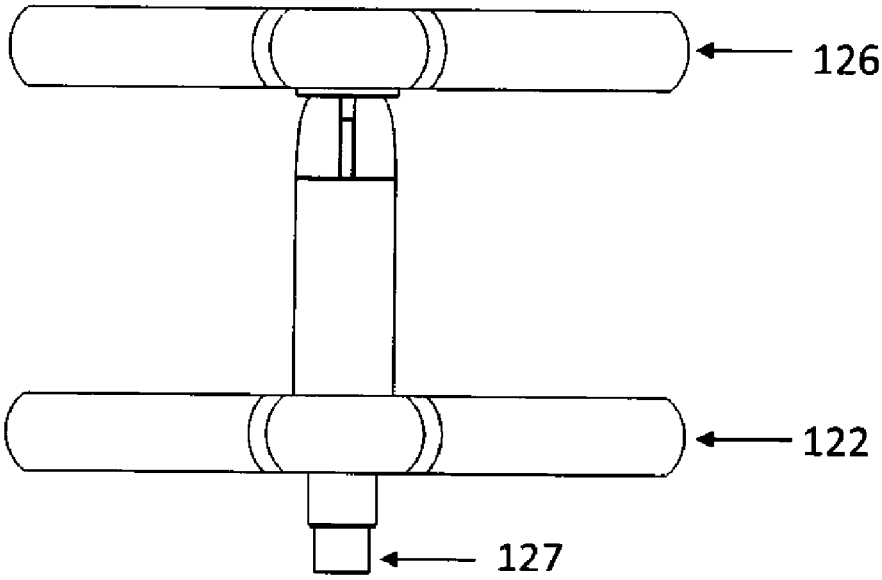
FIG. 19 is a front elevational view of the cup holding adapter of FIG. 16.

A plurality of hollow, telescoping legs 70 are provided wherein each leg 70 comprises a lower member 72 telescoping within a medial member 74, and an upper member 76 having the medial member 74 telescoping therein. As shown best in conjunction with FIG. 10 and FIG. 11, the telescoping legs 70 are constructed of a lightweight metal material such as aluminum. The upper member 76 is of a diameter measuring slightly larger than a diameter of the medial member 74, and the medial member 74 is of a diameter measuring slightly larger than a diameter of the lower member 72. The upper member 76 and the medial member 74 include a plastic sleeve 78 for being slidably received within an end of the upper member 76 and medial member 74, respectively, wherein a plastic sleeve 78 is designed and configured so as to accommodate a forward end 82 of a plastic collet 80. A rearward end 84 of the plastic collet 80 is insertably received within an end 74*b*, 72*b* of the medial member 74 and lower member 72, respectively, opposite ends 74*a*, 72*b* respectively. Once the collet 80 is inserted within its respective plastic sleeve 78 and a desired leg 70 length has been chosen, a slight turn of the chosen member 72, 74 effectively secures such member 72, 74 within a respective member 74, 76. The use of the collet 80 provides for substantial integrity and stability of the portable, compact computer and projector stand during operation.

In order to removably attach assembled telescoping legs 70, the table bottom 22 is provided with a plurality of integrally molded pockets 90 positioned in corners of the floor 49 thereof for slidably receiving and securing a telescoping leg 70 therein. The rearward end 84 of the plastic collet 80 is insertably received within an end 76*b* of the upper member 76 opposite end 76*a*, and held therein via frictional interference. The forward end 82 of the collet 80 is slidably received within pocket 90, and a subsequent slight turning of the upper member 76 serves to effectively secure such member 76 within the pocket 90.

In order to prevent inadvertent movement by the present invention during use, a plurality of rubber feet 88 are provided, wherein each foot 88 is slidably received within an end 72*a* of each lower member 72 opposite of end 72*b* thereof, and is removably held therein through frictional interference.

In order to remove the telescoping leg 70, the user simply turns the upper member 76 in an opposite direction of that which is stated hereinabove, thus allowing the telescoping leg 70 to be slidably removed from its respective pocket 90, and can subsequently be disassembled and placed within a medium density, closed cell foam insert 60 is provided and is dimensionally-shaped so as to correspondingly rest in a fitting and snug manner within the accessory insert receiving cavity 50. The foam insert 60 is die cut having a suitable adhesive adhered to an underside thereof, wherein the adhesive is of a type which both assures engagement of the underside of the foam insert with the floor of the table bottom 22, and allows for its removal and replacement within the accessory insert receiving cavity 50. The foam insert 60 includes a plurality of accessory-shaped cutouts 64 designed in various shapes for removably receiving telescoping legs 70 (to be described in greater detail below) and associated components. The design and dimensional shape of each accessory-shaped cutout 64 correlates with a particular telescoping leg 70 or accessory, thus each accessory-shaped cutout 64 is adapted so as to conform there around and provides a storage volume therefor.

Referring now to FIGS. 12-19, additional specific improvements to the improved portable, compact computer stand is shown in greater detail in the form of adaptations to incorporate article holders for organizing additional accessories, such as cell phones, beverage containers and the like. As shown in FIGS. 12-15, a cellular phone storage adapter 100 is provided for use in conjunction with the improved portable, compact computer and projector stand 10 according to the preferred embodiment of the present invention. A separable housing 102 is provided having a plurality of sidewalls 104 and a bottom surface 106 forming a containment cavity 108 therein. An attachment pin 110 is mounted cantilevered from the outer periphery of the housing 102 from one sidewall 104 to provide for attachment through impingement with a first receiving hole (not shown) in the table top 20. A closed cell foam insert 112 fitted within the containment cavity 108 is adapted to graspingly receive, and consequently securely hold, a cellular telephone, portable digital assistant (PDA) or similar handheld electronic device.

Further, as shown in FIGS. 16-19, a cup holding adapter 120 is shown for use in conjunction with the improved portable, compact computer and projector stand 10 according to the preferred embodiment of the present invention. A coaster support platform 122 is provided having an attachment pin 124 is mounted cantilevered from the outer periphery of the platform 122 to provide for attachment through impingement with a second receiving hole (not shown) in the table top 20. A upper containment ring 126 can further be adapted to attachably affix to and above the coaster support platform 122, and consequently form a secure beverage container holder.

The novel features which are characteristic of the present invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

2. Operation of the Preferred Embodiment

To use the present invention, a user removes the telescoping legs from the foam insert. The user then slidably engages the plastic sleeves within an end of each upper member and medial member. The user next inserts a forward end of a plastic collet within each plastic sleeve. Next, the user slidably inserts a rearward end of the plastic collet within an opposite end of the medial member and lower member. Once the user has inserted each collet within its respective plastic sleeve and has chosen a desired leg length, the user slightly turns a chosen member for effectively securing such member within its respective member.

In order to removably attach assembled telescoping legs, the user insertably engages the rearward end of each plastic collet within an opposing end of each upper member, whereby the collet is held therein via frictional interference. The user then slidably inserts each forward end of each collet within a pocket of the table bottom, and slightly turns the upper member to effectively secure such member within the pocket. The user then slidably inserts rubber feet within a lower end of each lower member in order to prevent inadvertent movement by the present invention during use. Next, the user selectively adjusts a desired linear length of the table top by linearly engaging the table top along the track guide of the table bottom.

Finally, the user removes the cup holding adapter 120 and the cellular phone storage adapter 100 from storage within the foam insert and slidably inserts the attachment pins within the receiving holes. This will then allow use of the work surface, while greatly increasing the functionality and flexibility of such portable workstation platforms with the use of such improvements and features not previously known or available.

When the user has completed his use of the present invention, the user simply reverses the aforementioned steps.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An improved portable, compact computer stand comprising:

a table top having a generally planar upper surface forming at least one receiving hole in said upper surface, said table top adapted for supporting a laptop computer and constructed of a rigid plastic material and further forming a sidewall circumscribing an outer periphery and forming a recessed lower surface opposite said planar upper surface;

a closed cell foam insert affixed within said recessed lower surface, said closed cell foam insert forming a plurality of die cut receiving cavities;

a plurality of telescoping legs, said plurality of telescoping legs being of a hollow configuration constructed of a lightweight metal material;

said recessed lower surface further including a plurality of integrally molded pockets positioned at corners of said lower surface, wherein each of said plurality of integrally molded pockets is designed and configured for slidably receiving and securing each of said plurality of telescoping legs; and an article holder for organizing additional accessories, said article holder having an attachment pin mounted cantilevered from an outer periphery for attachment through impingement with said at least one receiving hole.

2. The improved portable, compact computer stand of claim 1, wherein said article holder comprises:

a cellular phone storage adapter having a separable housing having a plurality of sidewalls and a bottom surface forming a containment cavity therein; and a closed cell foam insert fitted within said containment cavity, said insert adapted to graspingly receive and securely hold a cellular telephone, portable digital assistant (PDA) or similar handheld electronic device.

3. The improved portable, compact computer stand of claim 1, wherein said article holder comprises:

a cup holding adapter having a coaster support platform supporting said attachment pin cantilevered from an outer periphery of said platform; and an upper containment ring adapted to attachably affix to and above said coaster support platform;

wherein said article holder therein forms a secure beverage container holder.

4. The improved portable, compact computer stand of claim 1, wherein said closed cell foam insert includes a plurality of accessory-shaped cutouts designed in shapes adapted for removably containing said plurality of telescoping legs and said article holder.

5. An improved portable, compact computer stand comprising:

a table top having a generally planar upper surface forming at least a first receiving hole and a second receiving hole in said upper surface, said table top adapted for supporting a laptop computer and constructed of a rigid plastic material and further forming a sidewall circumscribing an outer periphery and forming a recessed lower surface opposite said planar upper surface;

a closed cell foam insert affixed within said recessed lower surface, said closed cell foam insert forming a plurality of die cut receiving cavities;

a plurality of telescoping legs, said plurality of telescoping legs being of a hollow configuration constructed of a lightweight metal material;

said lower surface further including a plurality of integrally molded pockets positioned at corners of said lower surface, wherein each of said plurality of integrally molded pockets is designed and configured for slidably receiving and securing each of said plurality of telescoping legs; and at least two article holders for organizing additional accessories, said article holders each having an attachment pin mounted cantilevered from an outer periphery for attachment through impingement with one of said receiving holes.

6. The improved portable, compact computer stand of claim 5, wherein one said article holder comprises:

a cellular phone storage adapter having a separable housing having a plurality of sidewalls and a bottom surface forming a containment cavity therein; and a closed cell foam insert fitted within said containment cavity, said insert adapted to graspingly receive and securely hold a cellular telephone, portable digital assistant (PDA) or similar handheld electronic device.

7. The improved portable, compact computer stand of claim 6, wherein a second said article holder comprises:

a cup holding adapter having a coaster support platform supporting said attachment pin cantilevered from an outer periphery of said platform; and an upper containment ring adapted to attachably affix to and above said coaster support platform;

wherein said article holder therein forms a secure beverage container holder.

8. The improved portable, compact computer stand of claim 6, wherein said closed cell foam insert includes a plurality of accessory-shaped cutouts designed in shapes adapted for removably containing said plurality of telescoping legs and said article holders.

* * * * *